United States Patent [19]

Burden

[11] Patent Number: 4,596,388

[45] Date of Patent: Jun. 24, 1986

[54] HURDLE ATTACHMENT STRUCTURE FOR TRAINING

[76] Inventor: J. S. Burden, 5209 Highland View Ave., Los Angeles, Calif. 90041

[21] Appl. No.: 568,409

[22] Filed: Jan. 5, 1984

[51] Int. Cl.[4] ..... A63B 5/02

[52] U.S. Cl. ..... 272/102

[58] Field of Search ..... 272/100, 101, 102, 103, 272/104, 105; 256/1, 12, 26; 119/29; 273/390, 391, 127 D

[56] References Cited

U.S. PATENT DOCUMENTS

| | | | |
|---|---|---|---|
| 732,680 | 6/1903 | Traxler | 256/12 |
| 1,607,650 | 11/1926 | Smith | 272/101 |
| 2,960,335 | 11/1960 | Shuttleworth | 272/100 |
| 3,061,306 | 10/1962 | Magill | 272/103 |
| 3,116,911 | 1/1964 | Dragunas et al. | 256/26 |

FOREIGN PATENT DOCUMENTS

| | | | |
|---|---|---|---|
| 390688 | 8/1908 | France | 272/102 |
| 916960 | 12/1946 | France | 273/390 |

*Primary Examiner*—Richard J. Apley
*Assistant Examiner*—S. R. Crow
*Attorney, Agent, or Firm*—Bernard P. Drachlis

[57] ABSTRACT

Attachment bar detachably clamps onto the regular cross bar of a hurdle. Hurdle bar is hingedly attached to the attachment bar so that during training, the hurdle bar can be tipped over without injury to the hurdler. The height of the hurdle bar and attachment bar is such that the hurdle can be adjusted to provide standard hurdle heights over the hurdle bar.

18 Claims, 3 Drawing Figures

HURDLE ATTACHMENT STRUCTURE FOR TRAINING

BACKGROUND OF THE INVENTION

This invention is directed to a hurdle attachment which can be attached to a standard hurdle structure. The hurdle attachment has a hurdle bar which can be easily knocked over without tipping the hurdle, to aid in training.

The standard hurdle has a regular bar secured to an L-shaped structure. The structure is usually adjustable to provide standard heights above the ground of the regular bar. Hurdle heights of 30 inches, 33 inches, 36 inches, 39 inches and 42 inches are normally required to accommodate both high school and college event hurdlers. Except for this adjustability, the hurdle is a rigid structure.

A series of such hurdles is placed along the track and oriented with the foot of the L toward the beginning of the track so that the hurdles can tip over when struck. Hurdling requires an intense level of concentration. On many occasions, the athlete is unaware of striking hurdles during his practice run only to find afterwards that his ankle or knee is bloodied. During the running of events, the tipover resistance of the hurdle is specified. However, during training, the hurdler can perform with a lower tipover resistance to avoid injury. However, it is desirable during training to be able to see which hurdles have been struck. With this information, the athlete can attempt to improve his stride, endurance and whatever is required. Thus, a training device is required.

SUMMARY OF THE INVENTION

In order to aid in the understanding of this invention, it can be stated in essentially summary form that it is directed to a hurdle attachment structure for attachment to a regular hurdle for the training of a hurdling athlete. The hurdle attachment comprises an attachment bar for clampon attachment to the regular bar. A hurdle bar is pivotably secured to the attachment bar so that the hurdle bar can be easily knocked over during training runs.

It is, thus, an object and advantage of this invention to provide a hurdle attachment which attaches to a standard hurdle with the hurdle attachment arranged so that its hurdle bar can be easily tipped over to permit a hurdler to train and attack the bar to hurdle confidently, knowing he will not be hurt if he touches and tips the hurdle bar.

It is a further object and advantage of this invention to provide a hurdle structure which can be attached to a conventional hurdle so that the conventional hurdle can be employed to position the hurdle bar and no additional structure is necessary to provide a hurdle attachment structure which can be used during training.

Other objects and advantages of this invention will become apparent from a study of the following portion of the specification, the claims and the attached drawings.

DESCRIPTION OF THE PREFERRED EMBODIMENT

Figure 1:
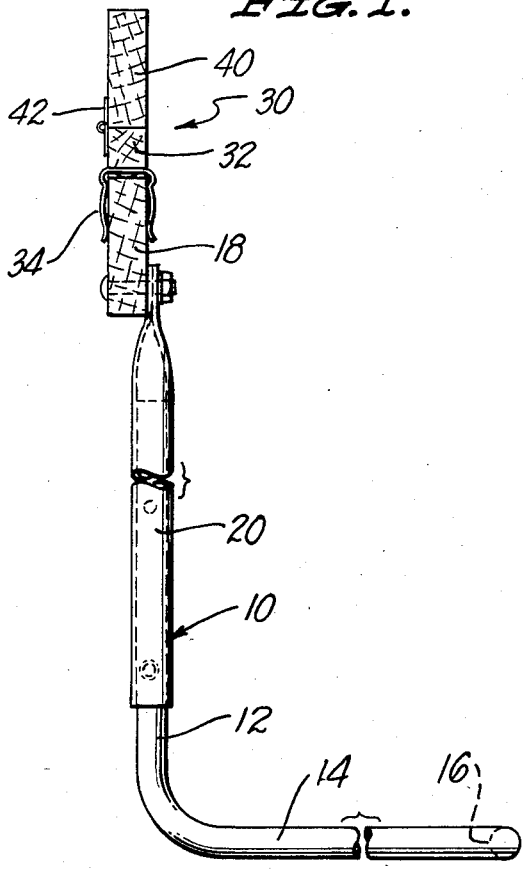
FIG. 1 is an end elevational view of the hurdle attachment structure of this invention shown attached to a conventional hurdle, with parts of the conventional hurdle being broken away.
Figure 2:
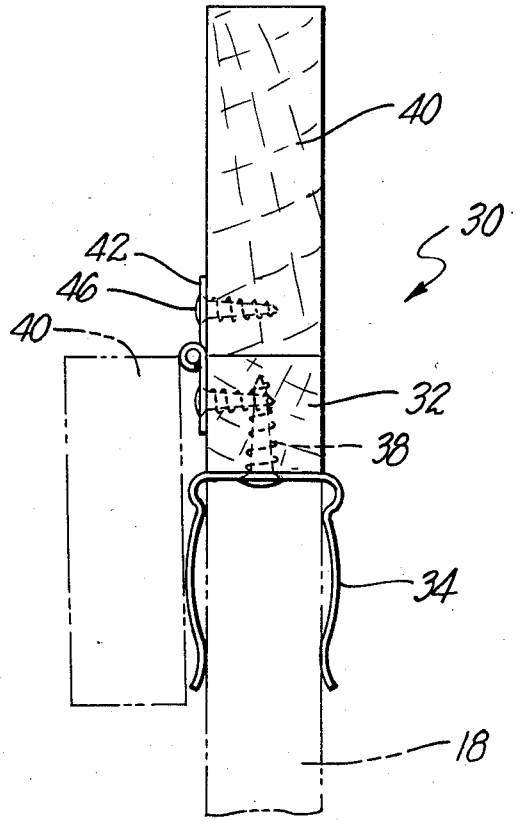
FIG. 2 is an enlarged side-elevational view of the hurdle attachment structure of this invention, showing the tilted position in dashed lines.
Figure 3:
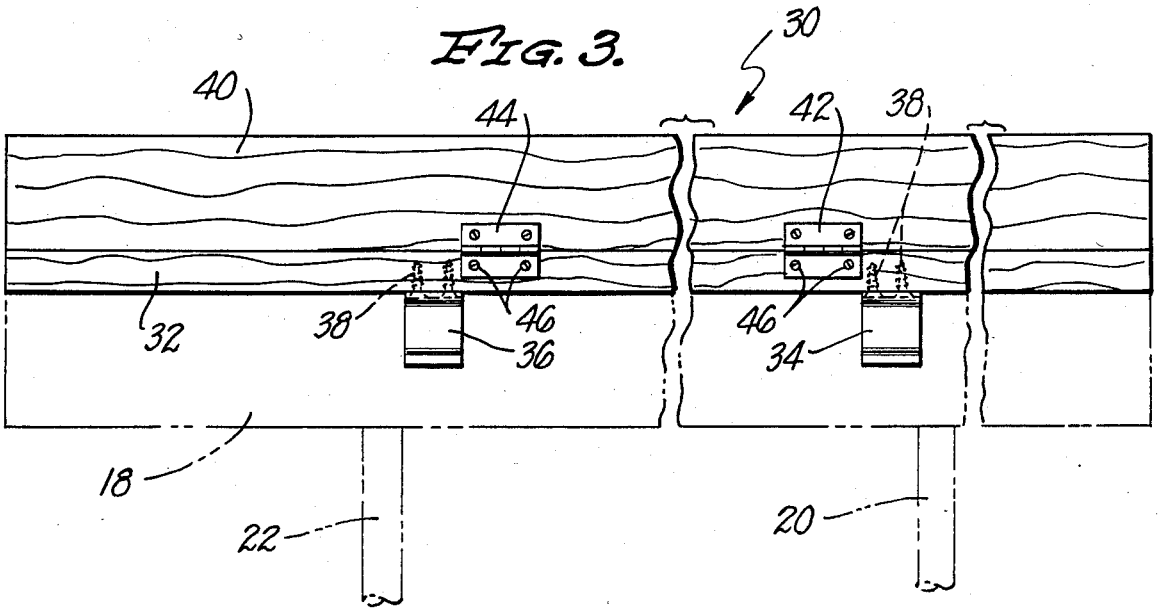
FIG. 3 is a rear-elevational view of the hurdle attachment structure of this invention, with parts broken away and with the standard hurdle shown in dashed lines.

A conventional hurdle is generally indicated at 10 in FIG. 1. One type of conventional hurdle 10 is illustrated, and as the specification proceeds, it will become clear that the hurdle attachment structure of this invention can be attached to any hurdle as used in modern track competition. Hurdle 10 is a simple L-shaped structure with two uprights and two feet. The near upright 12 and near foot 14 are shown in FIG. 1. They are connected with cross piece 16, which connects the near foot 14 with the far foot. This much structure can be made out of one piece of tube. Regular bar 18 may be bolted across the top of the two uprights, from upright 12 to its companion upright on the far side of FIG. 1. However, in most cases, adjustability is desirable. Thus, telescoping tube 20 is fitted over the top of the near upright 12 and telescoping tube 22, see FIG. 2, is fitted over the far upright in FIG. 1. Regular bar 18 is bolted across these uprights.

Adjustability is provided so that the hurdle 10 can be used in more than one of the conventional hurdle heights of 30, 36, 39 and 42 inches. The conventional hurdle is positioned so that the athlete approaches the hurdle from right to left in FIG. 1. The size and weight of the upright and on-the-ground components are arranged to provide proper tipover resistance. It is essential to proper technique that the hurdler confidently attack the hurdle. He can only do this if he does not fear injury. Some organizations which own traditional hurdles that meet the tipover resistance standards also purchase special lightweight hurdles which can be used in practice. Such lightweight hurdles permit the hurdler to practice and develop confident attack without fear of injury, but are expensive, bulky and take up valuable space.

The hurdle attachment structure 30 of this invention is a structure which can be attached to the conventional hurdle to provide a hurdle bar which can easily be tipped over to permit the development in training of a confident attack on the hurdle, without fear of injury. Hurdle attachment structure 30 comprises attachment bar 32 which is as thick as and as long as regular bar 18. The regular bar 18 is normally made of wood of $\frac{3}{4}$ inch thickness and, thus, the attachment bar 32 is $\frac{3}{4}$ inch thick. First and second spring clamps 34 and 36 are secured to the bottom of attachment bar 32 by any conventional means, such as screws 38. Spring clamps 34 and 36 are generally U-shaped with the opening facing downward and dimensioned to resiliently embrace the regular bar 18. The attachment of the spring clamps 34 and 36 on regular bar 18 are such that the attachment bar may be attached to the regular bar, as indicated, with confidence that it will stay in place and yet the attachment bar can be easily removed at completion of practice. Two spring clamps are shown, but more may be used.

Hurdle bar 40 is of wood, is preferably of the same thickness as attachment bar 32, and is the same length thereof so that it is the same length as regular bar 18.

Hinges 42 and 44 are secured to both attachment bar 32 and hurdle bar 40. Screws 46 are a convenient means of attachment. As is seen in FIGS. 1 and 2, when the hurdle bar is in its raised position, it is in edge-to-edge contact with attachment bar 32 and in alignment with regular bar 18. Gravity thus holds hurdle bar 40 in its upright position shown in these figures.

The hurdle attachment structure 30 is clamped onto the regular bar 18 with the hinges 42 and 44 directed away from the side of attack. The hinges are free-swinging so that the hurdler is confident that hurdle bar 40 will easily tip over and that he will not be injured by the tipover. The tipover position is shown in dashed lines in FIG. 2.

The attachment bar 32 is preferably ¾ inch in height, while the hurdle bar 40 is preferably 2¼ inches in height so that the total height of the two of them when the hurdle bar is in the erected position shown in FIG. 2 is 3 inches. This is a critical height because conventional hurdles are often arranged to be adjustable in fixed increments to the conventional hurdle heights of 30 inches, 33 inches, 36 inches, 39 inches and 42 inches. Thus, when the conventional hurdle 10 is set at 36 inches and the hurdle attachment structure 30 is attached, the effective height is 39 inches, which is a standard height. Similarly, when the regular hurdle 10 is set at 39 inches and the hurdle attachment structure 30 is attached thereto, the net height is 42 inches, which is also a standard height. In some cases, it will be feasible to reduce the height of the conventional hurdle 10 down to 27 inches so that the application of the hurdle attachment structure 30 raises the net height to 30 inches for practice use.

On many occasions, an athlete is unaware of striking hurdles during his training run due to the intense level of concentration, only to find himself bloodied at the end of the run. Practicing everyday as hurdlers do, nagging injuries are acquired. By the use of the hurdle attachment structure of this invention, he avoids this injury. Due to the tipping of the hurdle bar 40, after the run, the athlete can go back and see which hurdles have been struck. Knowing this, he can work on his stride, endurance, or whatever is required to improve the run. The hurdle attachment structure looks like the standard hurdle cross piece 16 so that the use of the hurdle attachment structure 30 during practice provides an appearance which is consistent with the hurdle 10 he will use in competition. Thus, training is improved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. In combination:

a track hurdle assembly and a track hurdle attachment structure, said track hurdle assembly comprising:

a horizontal rigid bar attached to a vertically adjustable frame, said track hurdle attachment structure comprising:

an attachment bar;

attachment means on said attachment bar for detachable mounting of said attachment bar on the top of said rigid bar on said track hurdle assembly;

a hurdle bar;

a free hinge secured to both said attachment bar and said hurdle bar so that said hurdle bar is pivotally secured and freely swinging to the top of said attachment bar so that said hurdle bar normally stands above said attachment bar and can be freely tipped over to a position lower than its upstanding position without resilient interaction between said attachment bar and said hurdle bar so that when said hurdle bar is tipped over it remains in the lowered position until manually restored.

2. The combination of claim 1 wherein said attachment means conprises a spring clamp secured to said attachment bar for detachable clamping upon said horizontal rigid bar.

3. The combination of claim 2 wherein said spring clamp is U-shaped spring clamp positioned with its open end facing downward for detachable clamping on said horizontal rigid bar.

4. The combination of claim 3 wherein said attachment bar is made of wood and said U-shaped spring clamp is attached to said attachment bar by means of wood screws.

5. The combination of claim 1 wherein said hinge has a pivot pin and said pivot pin is positioned on the side of said hurdle bar away from a hurdler as he uses the hurdle attachment structure.

6. The combination of claim 5 wherein said hinge is secured to said attachment bar and to said hurdle bar by means of screws.

7. The combination of claim 6 wherein the total height of said hurdle bar and said attachment bar is three inches.

8. The combination of claim 5 wherein said attachment means comprises a spring clamp secured to said attachment bar for detachable clamping upon said rigid bar.

9. The combination of claim 8 wherein said spring clamp is U-shaped spring clamp positioned with its open end facing downward for detachable clamping on said horizontal rigid bar.

10. The combination of claim 1 wherein the total height of said hurdle bar and said attachment bar is three inches.

11. The combination of claim 10 wherein said hurdle bar is made of wood and is of substantially the same length as said horizontal rigid bar on said track hurdle assembly.

12. In combination:

a track hurdle assembly and a track hurdle attachment structure, said track hurdle assembly comprising:

a horizontal rigid bar attached to a vertically adjustable frame, said track hurdle attachment structure comprising:

an attachment bar;

attachment means on said attachment bar for detachable mounting of said attachment bar on the top of said horizontal rigid bar;

a hurdle bar;

a free hinge secured to both said attachment bar and said hurdle bar, said free hinge having a pivot pin with said pivot pin positioned on the side of said hurdle bar away from a hurdler as he uses the hurdle attachment structure, said hurdle bar lying edge-to-edge on top of said attachment bar when said hurdle bar is in its upstanding position so that gravity retains said hurdle bar in its upstanding position where it normally stands above said attachment bar and said hurdle bar can be freely tipped over by a hurdler to a position lower than its upstanding position without resilient interaction between said hurdle bar and said attachment bar.

13. The combination of claim 12 wherein said attachment means comprises a spring clamp secured to said attachment bar for detachable clamping upon said horizontal rigid bar.

14. The combination of claim 13 wherein said spring clamp is U-shaped spring clamp positioned with its open end facing downward for detachable clamping on said horizontal rigid bar.

15. In combination:

a track hurdle assembly and a track hurdle attachment structure, said track hurdle assembly comprising:

a horizontal rigid bar attached to a vertically adjustable frame, said track attachment structure comprising:

an attachment bar;

first and second spring clamps secured to the bottom of said attachment bar, said spring clamps being generally U-shaped with the opening of the U-shape being directed substantially downward, said U-shaped spring clamp being dimensioned to releaseably clamp on said horizontal rigid bar of said track hurdle assembly in an upright position;

a hurdle bar, said hurdle bar having substantially the same length as the regular bar on a conventional hurdle, a free 3-piece hinge secured to both said attachment bar and said hurdle bar for piviotally attaching said hurdle bar to said attachment bar so that when said spring clamp engages on said horizontal rigid bar of said track hurdle assembly, said hurdle bar is pivotally secured to said attachment bar in edge-to-edge relationship and is retained in erected position only by gravity so that a hurdler can freely tip over said hurdle bar by freely swinging said hurdle bar to a lower position on its hinges without resilient interaction between said hurdle bar and said attachment bar and without personal injury and without tipping over a hurdleto which said hurdle attachment structure is attached.

16. The combination of claim 15 wherein said three piece hinge includes a hinge pin being positioned adjacent the side of said hurdle bar away from a hurdler as he approaches said track hurdle assembly so that said hurdle bar tips over in the direction of a hurdler passing over said hurdle bar.

17. The combination of claim 16 wherein said clamp, said attachment bar and said hurdle bar are dimensioned so that the top of said hurdle bar is three inches above the top of said horizontal rigid bar on said track hurdle assembly to which it is attached.

18. The combination of claim 17 wherein said hurdle bar is made of wood and has a height substantially the same as said horizontal rigid bar on said track hurdle assembly.

* * * * *